US005213298A

United States Patent [19]

Johnson

[11] Patent Number: 5,213,298

[45] Date of Patent: May 25, 1993

[54] MOUNTING BRACKET ASSEMBLY

[75] Inventor: Stephen P. Johnson, Olean, N.Y.

[73] Assignee: Cooper Power Systems, Inc., Coraopolis, Pa.

[21] Appl. No.: 634,015

[22] Filed: Dec. 26, 1990

[51] Int. Cl.[5] ..... A47K 1/08

[52] U.S. Cl. ..... 248/313; 248/315; 248/231; 174/158 R

[58] Field of Search ..... 248/313, 315, 674, 675, 248/316.1, 316.6, 231, 218.4, 58; 337/168-185; 174/158 R, 163 R

[56] References Cited

U.S. PATENT DOCUMENTS

| | | | |
|---|---|---|---|
| 123,498 | 2/1872 | McDonald | 248/315 |
| 1,264,446 | 4/1918 | Sears | 248/231 |
| 1,506,329 | 8/1924 | Pike | 248/315 |
| 1,911,380 | 5/1933 | McFarlin | 248/315 X |
| 2,114,876 | 4/1938 | Forbes . | |
| 2,277,737 | 3/1940 | Wilkinson | 248/313 |
| 2,451,550 | 10/1948 | Haller | 248/315 |
| 2,472,752 | 6/1949 | Mackereth | 248/315 X |
| 2,603,441 | 7/1952 | Emmart | 248/315 |
| 2,707,611 | 5/1955 | Fricke | 248/313 |
| 2,732,954 | 1/1956 | Janonis et al. | 248/315 X |
| 2,883,448 | 4/1959 | Hermann | 174/155 R |
| 2,897,255 | 7/1959 | Gesellschop | 174/163 R |
| 2,901,573 | 8/1959 | Gesellschap | 337/169 |
| 3,666,992 | 5/1972 | Goodman . | |
| 3,894,707 | 7/1975 | Heard | 248/231 |
| 4,094,487 | 6/1978 | Heard | 248/231 |
| 4,186,902 | 2/1980 | Simons | 174/163 R |
| 5,074,419 | 12/1991 | Smith | 211/17 |

FOREIGN PATENT DOCUMENTS

| | | | |
|---|---|---|---|
| 486979 | 9/1952 | Canada | 174/163 |

*Primary Examiner*—Alvin C. Chin-Shue
*Assistant Examiner*—Korie H. Chan
*Attorney, Agent, or Firm*—Gregory L. Maag

[57] ABSTRACT

A mounting bracket assembly for mounting an object to a support structure includes a hanger strap for gripping the object and a channel member for supporting the hanger strap. The hanger strap includes a lobe disposed about the object and inwardly projecting mounting tabs which engage aligned slots formed in the sides of the channel member. A single fastener is disposed through the hanger strap adjacent to the tabs so as to cause the lobe to simultaneously grip the arrester and to retain the mounting tabs in the slots.

22 Claims, 1 Drawing Sheet

MOUNTING BRACKET ASSEMBLY

BACKGROUND OF THE INVENTION

The present invention relates generally to mounting brackets and fixtures for mounting one object to another. More particularly, the invention relates to mounting brackets useful for mounting electrical apparatus. Still more particularly, the invention relates to an improved mounting bracket assembly for mounting surge arresters or other similarly shaped apparatus to a fixed support, such as a distribution transformer.

It is a common practice within the electrical utility industry to mount particular pieces of electrical apparatus on or adjacent to other electrical equipment. For example, surge arresters are typically mounted on the transformer or other equipment that they have been installed to protect, or mounted on some other nearby structure such as the utility pole that is supporting the transformer.

A variety of mounting assemblies have been employed to mount surge arresters and other objects to an adjacent structure. Most of these assemblies have employed a band-like hanger which is clamped around the object to be supported and then attached to a rigid bracket. The bracket, in turn, is fastened to some adjacent structure. Examples of such assemblies are disclosed in U.S. Pat. Nos. 1,911,380 and 2,472,752.

While mounting assemblies such as those disclosed in the U.S. patents referenced above have long been employed in the electrical utility industry, such mounting assemblies suffer from a number of drawbacks or deficiencies. For example, a particular weakness of the prior art designs lies in the means used to attach the hanger to the supporting bracket. It has been conventional practice to weld the band to the bracket, such as is disclosed in U.S. Pat. No. 2,472,752, or to rivet the band to the bracket as is disclosed in U.S. Pat. No. 1,911,380. Although these methods have generally proven reliable, defective welds or riveted connections can cause the mounting assembly to fail. Accordingly, the welds must be carefully performed and all such connections must be inspected during manufacture. The precision welding that is required is time consuming and, therefore, costly, and the inspection process introduces an additional step that increases the expense of manufacturing such assemblies.

In addition, the supporting brackets themselves are typically constructed from pieces of flat steel bar or plate that have been welded together into a particular shape. These weldments must likewise be carefully made and inspected. Despite such precautions, over time and with repeated use, such welded brackets tend to fatigue and may ultimately fail. Although typically made from relatively heavy gauge steel, the welded brackets have tended not to be as strong or rugged as is desirable. Failures of the bracket or of the connection between the hanger and bracket may each result in damage to expensive equipment, or may disconnect the surge arrester from the equipment it was employed to protect. In either instance, costly system outages may result.

Other problems common to conventional mounting bracket assemblies arise from the means typically employed to clamp the band about the surge arrester. In most such hangers, the band includes a pair of clamping tabs or projections which extend outwardly from the band and are employed to clamp the band securely about the surge arrester by means of a bolt that is disposed through aligned holes in the tabs. One such typical hanger is depicted in FIG. 1 of U.S. Pat. No. 3,666,992. Such outwardly extending projections consume valuable shipping space. For example, when distribution transformers designed for pole mounting are shipped with conventional arrester mounting brackets installed at the factory, the value of the space required for the outwardly extending clamping tabs may amount to several dollars per transformer. Furthermore, these clamping tabs serve as a perch for birds and other wildlife once the assembly is mounted in the field. When perched on these projections, it is not uncommon for such animals to come in contact with a live conductor or terminal. Such a wildlife perch not only creates a hazard for the wildlife, but often leads to short circuits or system faults which again may lead to power outages.

Accordingly, there remains a need in the art for a strong and durable mounting bracket assembly for surge arresters and similar apparatus. Preferably, such an assembly would include a reliable arrangement for attaching the hanger to the supporting bracket. Ideally, the bracket and the assembly as a whole would be free of welds and of outwardly extending clamping tabs, and would be simple to manufacture and install in the field with a minimum of components.

Other objects and advantages of the invention will appear from the following description.

SUMMARY OF THE INVENTION

The present invention improves upon present day mounting bracket assemblies used to support surge arresters or similar such objects. According to the invention, the mounting bracket assembly comprises a hanger assembly for gripping the surge arrester and a bracket member for connecting the hanger assembly to some adjacent structure. The bracket member, which may be of formed steel channel, includes a base portion and a pair of sides extending from the base. The bracket further includes a pair of aligned apertures or slots formed in the sides of the bracket. The hanger assembly includes a strap having a lobe portion disposed about the surge arrester body and a pair of neck segments connected to the lobe. The neck segments are formed with opposing tabs which are received in the slots formed in the sides of the bracket member. A carriage bolt or similar fastener is disposed through the neck segments and, when tightened, draws the neck segments towards one another, thereby causing the lobe to grip the surge arrester and causing the tabs to be retained in the slots of the mounting bracket.

The mounting bracket assembly of the present invention can be manufactured free of weldments which can weaken and fail. Further, the invention is free of outwardly extending clamping tabs which otherwise serve as a wildlife perch and can result in system outages and costly down time. Further, the elimination of such clamping tabs saves costly shipping space. Employing a single fastener to clamp the hanger about the surge arrester and to retain the hanger assembly on the bracket member is also economical and is easily installed in the field.

BRIEF DESCRIPTION OF THE DRAWINGS

For an introduction to the detailed description of the preferred embodiment of the invention, reference will now be made to the accompanying drawings, wherein.

DESCRIPTION OF THE PREFERRED EMBODIMENT

The present invention relates in general to brackets for mounting any of a variety of types of objects to a fixed structure. A typical application for the invention is for mounting a surge arrester to a transformer enclosure or other nearby support. Accordingly, for purposes of example only, and not by way of limiting the present invention in any way, the present invention will be described with reference to mounting a surge arrester from a distribution transformer.

Figure 1:
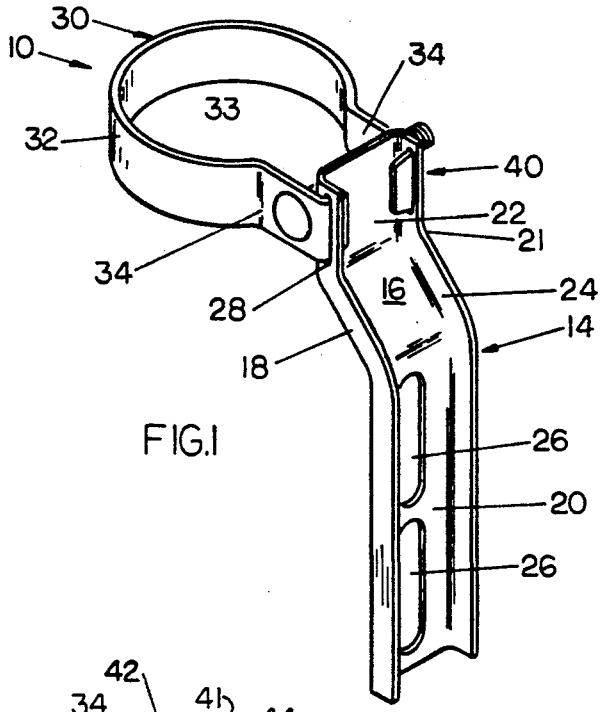
FIG. 1 shows a perspective view of the mounting bracket assembly of the present invention.
Figure 3:
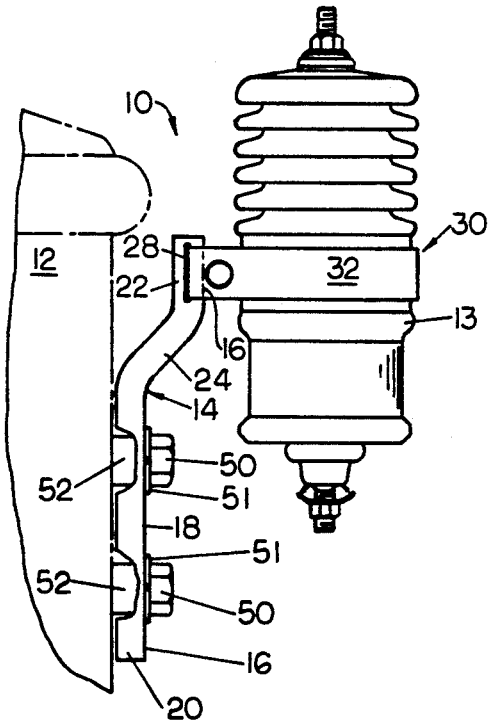
FIG. 3 shows an elevation view of the mounting bracket assembly of FIG. 1 when employed to mount a surge arrester on an electrical distribution transformer.

Referring now to FIG. 1, there is shown a mounting bracket assembly 10 made in accordance with the teachings of the present invention. Mounting bracket assembly 10 generally comprises mounting channel 14, a hanger assembly 30 and clamping means 40. In the preferred embodiment, mounting channel 14 is manufactured without welds and is made of formed steel channel having a galvanized finish. Channel 14 is a C-shaped cross section having a base portion 16 and ribs or sides 18 which extend substantially perpendicularly from base portion 16. The formed steel channel of mounting channel 14 provides for increased strength and reduced weight as compared with prior art brackets. In the preferred embodiment, mounting channel 14 is formed of a single continuous piece of channel, C-shaped in cross section, that is curved or bowed at 21 to form a lower straight segment 20 and an upper straight segment 22 interconnected by an intermediate curved segment 24. As best shown in FIG. 3, the base portion 16 of lower and upper straight segments 20 and 22 are substantially parallel, but are offset from one another by intermediate curved segment 24. This offset provides the mounting clearance necessary for mounting the surge arrester adjacent to the supporting structure. While those skilled in the art will recognize that the shape and dimensions of channel 14 may be varied depending on the size and weight of the surge arrester to be mounted, one such mounting channel 14 found to be particularly useful is a channel that has a base portion 16 approximately 1.75 inches wide and has ribs or sides 18 that are approximately 0.58 inches wide. This channel 14 is made of 12 gauge steel and has straight segments 20 and 22 offset by a distance of approximately 1.38 inches and an intermediate curved segment 24 angled from segments 20 and 22 at approximately 57°.

Although in the preferred embodiment, mounting channel 14 is made from formed steel channel having a galvanized finish, channel 14 may be successfully manufactured from a number of other materials. For example, channel 14 may be made of stainless steel or entirely of galvanized steel. Alternatively, channel 14 may be made of an insulating material, such as glass-filled polyester, which is the preferred material for mounting channel 14 when the arrester to be supported by the mounting bracket assembly 10 is a polymer-housed arrester. Further, when channel 14 is manufactured from steel or other metal, it is preferred that it be formed or drawn from a single flat piece of metal which is bowed and formed into its C-shaped cross section all in one continuous manufacturing procedure. Alternatively, when made of metal, channel 14 may be rolled, molded or extruded into the desired configuration described previously.

Referring briefly to FIG. 3, mounting bracket assembly 10 is shown mounted on transformer 12. As shown, bolts 50 are disposed through lock washers 51 and mounting holes 26 in lower segment 20 of mounting channel 14 and threadingly engage bosses 52 on transformer 12. As best shown in FIG. 1, mounting holes 26 are elongate so as to provide a means for vertically adjusting the mounting height of mounting bracket assembly 10. Referring still to FIG. 1, upper segment 22 includes elongate slots 28 formed in sides 18 which are adapted for engaging hanger assembly 30, as described in more detail below. Slots 28 are preferably rectangular in shape and approximately 1.031 inches long and 0.136 inches wide, although other shapes and sizes may be employed.

Figure 2:
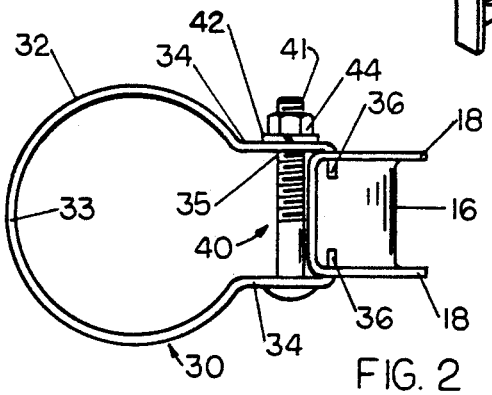
FIG. 2 shows a top plan view of the mounting bracket assembly of FIG. 1.

Hanger assembly 30, best shown in FIG. 2, generally comprises a hanger strap 32 and a clamping means 40 for tightening the hanger strap 32 about the object to be supported, such as surge arrester 13 shown in FIG. 3. Referring again to FIG. 2, hanger strap 32 comprises a metallic band formed to include a lobe portion 33, integral neck portions 34 and end tabs 36. Strap 32 is preferably approximately 1 inch wide. Lobe 33 is formed to generally conform to the circumference of the surge arrester 13. Neck portions 34 extend from lobe 33 toward mounting channel 14. Extending substantially perpendicularly from neck portions 34 are opposing mounting tabs 36 which are received within slots 28 formed in sides 18 of upper segment 22 of mounting channel 14.

As shown in FIG. 2, clamping means 40 engages neck portions 34 to draw neck portions 34 toward one another, thereby tightening and clamping lobe 33 about arrester 13 and retaining mounting tabs 36 in slots 28 of channel 14. In the preferred embodiment, clamping means 40 comprises a carriage bolt 41. Neck portions 34 include aligned holes 3 through which carriage bolt 41 is disposed. Lock washer 42 is disposed about carriage bolt 41 between neck portion 34 and nut 44. As nut 44 is tightened, hanger strap 32 is tightened about arrester 13. Thus the single clamping means 40 clamps surge arrester 13 within hanger assembly 30, secures hanger assembly 30 to mounting channel 14 and eliminates the outwardly extending clamping tabs of the prior art which consume valuable shipping space and provide a wildlife perch which creates a hazard for wildlife and often causes faults which can result in system outages. Another advantage is that the single clamping means 40 simultaneously secures hanger assembly 30 to mounting channel 14 and causes lobe 33 to tighten about and clamp arrester 13.

Figure 4:
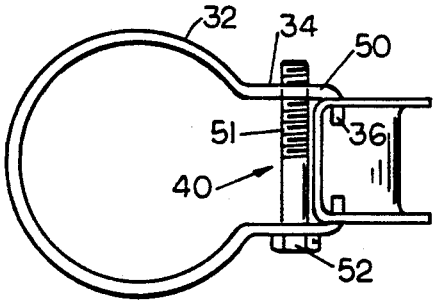
FIG. 4 shows a top plan view of an alternative embodiment of the mounting bracket assembly shown in FIG. 2.

An alternative embodiment of clamping means 40 is depicted in FIG. 4. As shown in FIG. 4, bolt 51 may be employed to secure hanger assembly 30 to mounting channel 14 without the use of lock washer 42 or nut 44.

In this embodiment, one neck segment 34 is provided with a threaded aperture 50 that is adapted to engage the threaded shank of bolt 51. As bolt head 52 is rotated, neck segments 34 are drawn together, thereby tightening strap 32 about the surge arrester and securing tabs 36 in slots 28.

While the preferred embodiment of this invention has been shown and described, modifications thereof can be made by one skilled in the ar without departing from the spirit of the invention. The embodiments described herein are exemplary only and are not limiting. Many variations and modifications of the system and apparatus are possible and are within the scope of the invention. Accordingly, the scope of protection is not limited by the above description, but is only limited by the claims which follow, that scope including all equivalents of the subject matter of the claims.

What is claimed is:

1. A mounting bracket assembly, comprising:

a bracket member having a base portion and a pair of sides extending therefrom;

a pair of apertures formed in said sides of said bracket member;

a hanger strap adapted for gripping an object with an adjustable force, said hanger strap having a lobe portion adjoined to a pair of neck segments and having a pair of opposing tabs extending from said neck segments toward one another, said tabs being non-rotatably disposed in said apertures of said bracket sides; and means for clamping said neck segments in a fixed relationship, said clamping means comprising means for adjusting the force with which said hanger strap grips the object.

2. The mounting bracket assembly of claim 1 wherein said bracket member comprises a steel channel.

3. The mounting bracket assembly of claim 2 wherein said apertures comprise elongate slots sized so as to receive said tabs and prevent rotation of said tabs relative to said slots.

4. The mounting bracket assembly of claim 3 wherein said clamping means comprises a fastener disposed through said neck segments.

5. The mounting bracket assembly of claim 4 wherein said assembly is free of welds.

6. A mounting bracket assembly for mounting an object on a structure, comprising:

a channel member having a base portion and a pair of sides extending therefrom;

a pair of elongate slots formed in said sides of said channel member, said slots oriented so as to have their longest dimension in a first direction substantially parallel to the longitudinal axis of the object and their narrowest dimension in a second direction substantially perpendicular to said first direction;

a hanger assembly for griping the object, said hanger assembly comprising a hanger strap disposed about the object, said strap having opposing tabs formed on the ends of said strap and disposed in said slots in said channel sides;

a pair of aligned holes formed in said hanger strap adjacent said tabs;

means for tightening said hanger strap about the object and simultaneously forcing said tabs further into said slots, thereby securing said hanger assembly to said channel member, said tightening means comprising a fastener disposed through said holes in said hanger strap.

7. The mounting bracket assembly of claim 6 wherein said channel member comprises a steel channel having a first segment substantially parallel to and offset from a second segment.

8. The mounting bracket assembly of claim 7 wherein one of said segments includes elongate mounting holes formed in said base portion.

9. The mounting bracket assembly of claim 6 wherein said fastener comprises a bolt secured by a nut.

10. The mounting bracket assembly of claim 6 wherein one of said aligned holes in said hanger strap threadingly engages said fastener.

11. A mounting bracket assembly for mounting a first object to a second object, comprising:

a channel member having a base portion and a pair of sides extending substantially perpendicularly therefrom, said channel member including integral first and second segments offset by a connecting segment such that said base portions of said first and second segments are substantially parallel to one another;

a pair of elongate mounting slots formed through said sides of said first channel segment;

a plurality of elongate mounting holes formed in said base portion of said second channel segment for attaching said channel member to the second object;

a mounting hanger for gripping the first object, said hanger comprising a hanger strap having a lobe disposed about the first object and a pair of neck segments connected to said lobe, said neck segments including opposing tabs formed on the ends of said strap and extending substantially at right angles to said neck segments wherein said opposing tabs are disposed through said slots in said channel sides and wherein said tabs are substantially rectangular in cross section, the width of said cross section being slightly less than the width of said slots such that once disposed in said slots, rotation of said tabs is substantially prevented; and means for drawing said neck segments toward one another and clamping the first object within said lobe, and simultaneously drawing said tabs further into said slots in said channel member sides.

12. The mounting bracket assembly of claim 11 wherein said channel member is a steel channel having a generally C-shaped cross section.

13. The mounting bracket assembly of claim 11 wherein said drawing means comprises a pair of aligned holes formed through said neck segments and a fastener disposed through said aligned holes.

14. A mounting bracket assembly for mounting an object, comprising:

a mounting channel free of welds;

a hanger strap for gripping the object with an adjustable compressive force, said hanger strap including tabs slidingly and non-rotatably disposed through said mounting channel; and means for tightening said hanger strap about the object and causing said tabs to be retained in said mounting channel.

15. The mounting bracket assembly of claim 14 wherein said tightening means comprises aligned holes formed in said hanger strap adjacent said tabs and a fastener disposed through said aligned holes.

16. The mounting bracket assembly of claim 15 wherein said hanger strap includes a continuous band disposed about the object wherein said band is free from outwardly extending projections.

17. The mounting bracket assembly of claim 14 wherein said mounting channel comprises a steel channel curved to form a first segment substantially parallel to and offset from a second segment, wherein said tabs are disposed through said first segment of said mounting channel.

18. The mounting bracket assembly of claim 17 wherein said first segment includes elongate slots formed therein and wherein said tabs are received in said slots and wherein said tabs and said slots are configured such that, once said tabs are disposed in said slots, rotation of said tabs is substantially prevented.

19. A mounting bracket assembly for mounting a device to a structure, comprising:

a support base adapted for attachment to the structure;

a mounting strap adapted for attachment to the device;

connection means for connecting said mounting strap to said support base, said connection means substantially preventing said strap from pivoting with respect to said support base; and tightening means for simultaneously tightening said connection means and tightening said mounting strap around the device, said tightening means consisting of a single fastener disposed through said mounting strap at a location adjacent to said support base, said support base comprising a steel channel.

20. The mounting bracket of claim 17 wherein said support base is free of welds.

21. The mounting bracket of claim 19 wherein said support base includes ribs and includes slots formed in said ribs and wherein said connection means comprises tabs extending from said mounting strap and received in said slots.

22. A mounting bracket assembly for mounting a device to a structure, comprising:

a support base adapted for attachment to the structure;

a mounting strap adapted for attachment to the device;

connection means for connecting said mounting strap to said support base, said connection means substantially preventing said strap from pivoting with respect to said support base; and tightening means for simultaneously tightening said connection means and tightening said mounting strap around the device, said tightening means consisting of a single fastener disposed through said mounting strap at a location adjacent to said support base, said support base comprising channel having a C-shaped cross section, said channel formed of an insulating material.

* * * * *